United States Patent [19]

Porter et al.

[11] Patent Number: 5,027,974

[45] Date of Patent: Jul. 2, 1991

[54] COTTON ROLL DISPENSER

[75] Inventors: Michael D. Porter, Charlotte, N.C.; Jack D. Bankier, Northbrook, Ill.

[73] Assignee: Barnhardt Manufacturing Company, Charlotte, N.C.

[21] Appl. No.: 482,570

[22] Filed: Feb. 21, 1990

[51] Int. Cl.[5] ..... B65H 3/00

[52] U.S. Cl. ..... 221/196; 221/266; 221/203

[58] Field of Search ..... 221/196, 266, 202–205

[56] References Cited

U.S. PATENT DOCUMENTS

| | | | |
|---|---|---|---|
| 1,928,603 | 9/1933 | Skareen | 221/266 |
| 2,004,805 | 6/1935 | D'Agostino | 221/196 |
| 2,319,570 | 5/1943 | Whorton et al. | 221/266 X |
| 2,387,470 | 10/1945 | Seegar et al. | 221/196 |
| 2,434,257 | 1/1948 | Burch | 221/266 X |
| 2,587,225 | 2/1952 | Rossi | 221/266 X |
| 2,684,179 | 7/1954 | Sachs | 221/196 |
| 2,923,437 | 2/1960 | Miller | 221/266 |
| 3,445,037 | 5/1969 | Rothbaum | 221/266 X |
| 4,308,974 | 1/1982 | Jones | 221/266 |

*Primary Examiner*—Kevin P. Shaver

*Attorney, Agent, or Firm*—Rhodes, Coats & Bennett

[57] ABSTRACT

This invention relates to an apparatus for dispensing cotton rolls. More particularly, this invention relates to an apparatus which may be supported on a work table, credenza, sideboard or the like in use in an operating room such as a dental operatory for readily supplying users such as dentists, surgeons, and assistants with absorbtive cotton rolls. The dispenser has a base which defines a delivery chute portion having horizontally spaced apart, upwardly directed surfaces, to which rolls are dispensed from a reservoir formed in part by a pair of planar lower wall portions, each lying on a plane parallel to said axis of rotation and diverging upwardly from a juncture line below the location of the axis of rotation of a dispensing wheel, and which direct rolls to the dispensing wheel which is mounted for rotation about a generally horizontal axis spaced above the delivery chute.

7 Claims, 1 Drawing Sheet

COTTON ROLL DISPENSER

FIELD AND BACKGROUND OF INVENTION

This invention relates to an apparatus for dispensing cotton rolls. More particularly, this invention relates to an apparatus which may be supported on a work table, credenza, sideboard or the like in use in an operating room such as a dental operatory for readily supplying users such as dentists, surgeons, and assistants with absorbtive cotton rolls.

Cotton rolls have been used for some long time in absorbing liquids in various operating procedures, particularly dental operating procedures where saliva must be captured to maintain a dry operating field. Such rolls have been supplied to users, such as dentists, surgeons and their assistants, from dispensers which retain a quantity of rolls and are intended to present them one at a time for use.

Prior cotton roll dispensers have suffered from deficiencies and difficulties in use in that they are usually opaque, and thus conceal from view any remaining supply of rolls, leaving a user uncertain as to whether rolls are present to be dispensed. Further, with at least some dispensers, it has been difficult for a user to grasp a roll being dispensed, thus making it difficult for rolls to be brought quickly into use when speed may be required. Both of these problems have arisen, at least in part, out of a necessity (for surgical applications) of maintaining the rolls sterile.

SUMMARY OF THE INVENTION

With the foregoing in mind, it is an object of this invention to provide an apparatus which retains a quantity of cotton rolls and readily dispenses the rolls for use. In realizing this object of the invention, reliance for dispensing of rolls is placed on a movable trap dispensing wheel, while rolls are passed to the wheel from a reservoir which particularly facilitates release of the rolls.

Yet a further object of the invention is to enable a user of cotton rolls in dental and surgical procedures to more readily grasp rolls dispensed for use. In realizing this object of the present invention, rolls are presented by being supported at the ends only, and with a midportion of the length of the roll being exposed for grasping.

BRIEF DESCRIPTION OF DRAWINGS

Some of the objects of the invention having been stated, other objects will appear as the description proceeds, when taken in connection with the accompanying drawings, in which.

DESCRIPTION OF PREFERRED EMBODIMENTS

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the drawings, a I5 dispenser in accordance with this invention is there shown and identified generally at I0. The dispenser 10 has a base 11, a dispensing wheel indicated generally at 12, and a reservoir indicated generally at 14.

Figure 2:
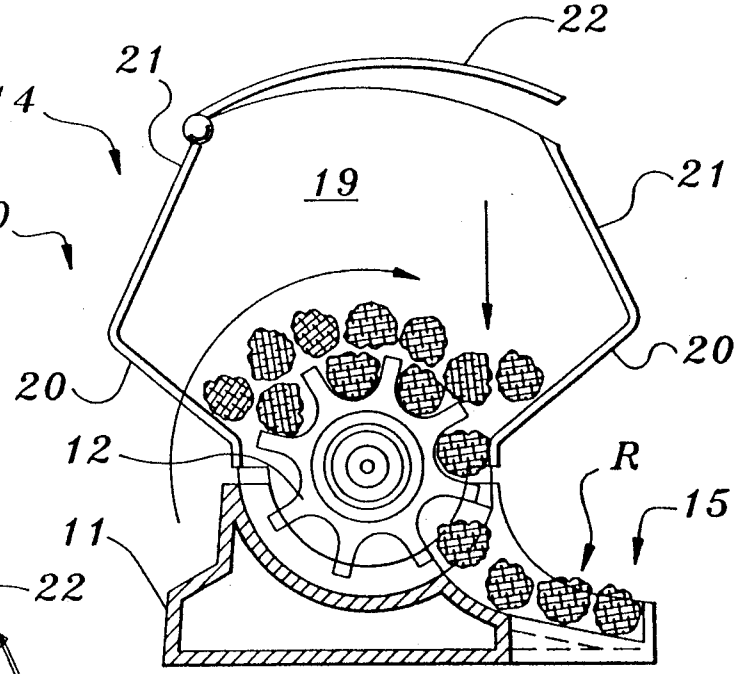
FIG. 2 is an elevation view, in section, through the dispenser of FIG. 1.
Figure 3:
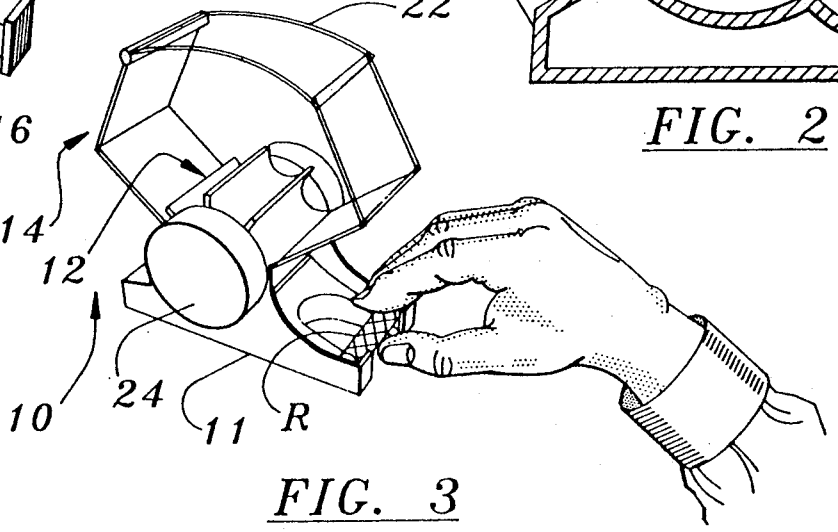
FIG. 3 is a view similar to FIG. 1 showing the dispensation of a roll from the dispenser.

The base 11 is adapted for positioning on a supporting surface such as a worktable, credenza or sideboard and defines a delivery chute portion 15 having horizontally spaced apart, upwardly directed surfaces 16 for receiving and supporting cotton rolls being dispensed (such as rolls indicated at R in FIGS. 2 and 3). The horizontally spaced apart roll support surfaces 16 are elevated above the supporting surface and separated by a predetermined distance to be bridged by a dispensed cotton roll for facilitating grasping of a dispensed cotton roll with forceps or between the gloved fingers of a user (FIG. 3).

The dispensing wheel means 12 is mounted in the base 11 for rotation about a generally horizontal axis spaced above the delivery chute portion 15, and defines a plurality of radially distributed roll receiving grooves 18. The grooves are formed about radially extending central planes which extend through the axis of rotation of the wheel, and are formed by surfaces lying parallel to the central planes, spaced apart by a distance greater than the diameter of a cotton roll to be dispensed, and joined near the axis of rotation by a half circular cylindrical surface so that the groove, in cross section taken in a plane perpendicular to the axis of rotation, is of a U shape configuration (FIG. 2).

The reservoir means 14 functions for retaining a supply of cotton rolls R and supplying the rolls to the wheel 12 for dispensation to the delivery chute portion 15 of the base 11. The reservoir is mounted on the base and defined by sets of walls.

The walls include a pair of side walls 19 extending perpendicular to the axis of rotation of the wheel 12 and spaced one from the other at a predetermined distance greater than the length of a roll to be dispensed. The side walls 19 are at least translucent, and preferably transparent, in order that a user may visually determine the supply of rolls R retained in the reservoir.

The reservoir 14 is further defined by end walls formed by a pair of planar lower wall portions 20, each lying on a plane parallel to the axis of rotation and diverging upwardly from a juncture line of the planes below the location of the axis of rotation see FIG. 2). It is to be noted that the walls themselves do not so extend, as to do so would cause interference with the rotation of the wheel 12.

Figure 1:
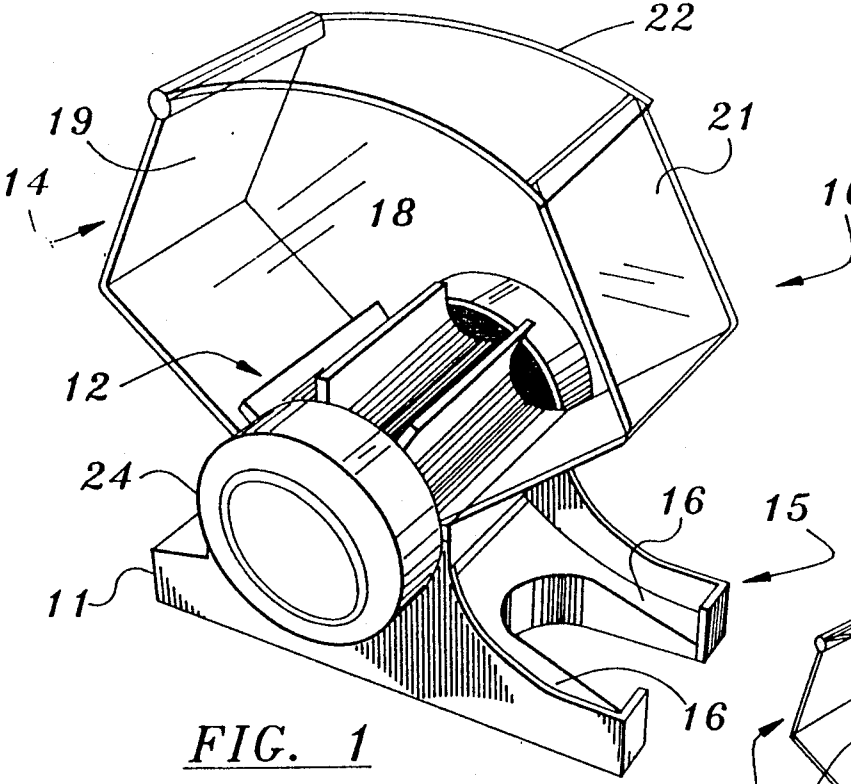
FIG. 1 is a perspective view of a cotton roll dispenser in accordance with this invention.

Upper wall members close the remaining space between the side walls 19. The upper wall members include a pair of planar upper wall portions 21, each lying on a plane parallel to the axis of rotation and converging upwardly toward a juncture line spaced above the dispenser means 10. A movable closure means 22 is connected with one of the upper wall portions 21 for movement between a raised loading position (not shown) and a lowered use position (FIGS. 1 and 3). The closure means 22 lies along a cylindrical surface about the axis of rotation of the wheel 12.

As can be seen in FIG. 2, the wheel 12 is in contact with a plurality of cotton rolls in the reservoir 14. The cotton roll supply is therefore agitated by the paddles separating the grooves as the wheel 12 is rotated, so that the cotton rolls separate from one another. Individual rolls can therefore fall into the grooves 18, and the rolls do not jam in the device. As will also be apparent, the wheel 18 may be rotated in either direction to achieve this effect, along with the feeding of a cotton roll in a leading groove to the delivery chute.

In use, the wheel 12 is rotated by a user manually grasping handles or knobs 24 affixed to the wheel and located outwardly of the base 11, so that rotation of the wheel 12 traps a cotton roll R held in the reservoir 14 and moves a trapped cotton roll from the reservoir to the delivery chute portion of the base for grasping by a user.

In the drawings and specifications there has been set forth a preferred embodiment of the invention and, although specific terms are used, the description thus given uses terminology in a generic and descriptive sense only and not for purposes of limitation.

What is claimed is:

1. Cotton roll dispenser means comprising:

a base for positioning on a supporting surface and defining a delivery chute portion having horizontally spaced apart, upwardly directed surfaces, dispensing wheel means mounted in said base for rotation about a generally horizontal axis spaced above said delivery chute portion, said wheel means defining a plurality of radially distributed roll receiving grooves, and reservoir means for retaining a supply of cotton rolls and supplying the rolls to said wheel means for dispensation to said delivery chute portion of said base, said reservoir means being mounted on said base and being defined by a pair of side walls extending perpendicular to said axis of rotation and spaced one from the other at a predetermined distance and further defined by end walls formed by a pair of planar lower wall portions, each lying on a plane parallel to said axis of rotation and diverging upwardly from a juncture line below the location of said axis of rotation, and upper wall members closing the remaining space between said side walls, whereby rotation of said wheel means will trap a cotton roll held in said reservoir means and move a trapped cotton roll from said reservoir means to said delivery chute portion of said base for grasping by a user.

2. Apparatus according to claim 1 wherein said horizontally spaced apart roll support surfaces of said base are elevated above the supporting surface and separated by a predetermined distance to be bridged by a dispensed cotton roll for facilitating grasping of a dispensed cotton roll.

3. Apparatus according to claim 1 wherein said wheel means defines a plurality of radially distributed roll receiving grooves which are formed about radially extending central planes which extend through said axis of rotation of said wheel means, and further wherein said grooves are formed by surfaces lying parallel to said central planes, spaced apart by a distance greater than the diameter of a cotton roll to be dispensed, and joined near said axis of rotation by a half circular cylindrical surface whereby the groove, in cross section taken in a plane perpendicular to said axis of rotation, is of a U shape configuration.

4. Apparatus according to claim I wherein said side walls defining said reservoir means are spaced one from the other at a distance along said axis of rotation which is greater than the length of a cotton roll to be dispensed.

5. Apparatus according to claim 1 wherein said upper wall members defining said reservoir means further comprise a pair of planar upper wall portions, each lying on a plane parallel to said axis of rotation and converging upwardly toward a juncture line spaced above said dispenser means.

6. Apparatus according to claim 5 wherein said upper wall members defining said reservoir means further comprise a movable closure means connected with one of said upper wall portions for movement between a raised loading position and a lowered use position and lying along a cylindrical surface about said axis of rotation.

7. Cotton roll dispenser means comprising:

a base for positioning on a supporting surface and defining a delivery chute portion having horizontally spaced apart, upwardly directed roll support surfaces elevated above the supporting surface and separated by a predetermined distance to be bridged by a dispensed cotton roll for facilitating grasping of a dispensed cotton roll, dispensing wheel means mounted in said base means for rotation about a generally horizontal axis spaced above said delivery chute portion, said wheel means defining a plurality of radially distributed roll receiving grooves, and reservoir means for retaining a supply of cotton rolls and supplying the rolls to said wheel means for dispensation to said delivery chute portion of said base, said reservoir means being mounted on said base and being defined by a pair of parallel planar side walls extending perpendicular to said axis of rotation and spaced one from the other at a predetermined distance greater than the length of cotton rolls to be dispensed, said reservoir means including means for permitting visual determination of the presence of a supply of rolls and being further defined by end walls and a top formed by a pair of planar lower wall portions, each lying on a plane parallel to said axis of rotation and diverging upwardly from a juncture line below the location of said axis of rotation, a pair of planar upper wall portions, each lying on a plane parallel to said axis of rotation and converging upwardly toward a juncture line spaced above said dispenser means, and a movable closure means connected with one of said upper wall portions for movement between a raised loading position and a lowered use position and lying along a cylindrical surface about said axis of rotation, whereby rotation of said wheel means will trap a cotton roll held in said reservoir means and move a trapped cotton roll from said reservoir means to said delivery chute portion of said base for grasping by a user.

* * * * *